US005999128A

United States Patent [19]

Stephens et al.

[11] Patent Number: 5,999,128

[45] **Date of Patent: *Dec. 7, 1999**

[54] MULTIBEAM PHASED ARRAY ANTENNAS AND METHODS

[75] Inventors: Ronald R. Stephens, Westlake Village; Jar J. Lee, Irvine, both of Calif.

[73] Assignee: Hughes Electronics Corporation

[ * ] Notice: This patent is subject to a terminal disclaimer.

[21] Appl. No.: 09/081,497

[22] Filed: May 19, 1998

[51] Int. Cl.[6] ..... H01Q 3/22

[52] U.S. Cl. ..... 342/375

[58] Field of Search ..... 342/368, 371, 342/375

[56] References Cited

U.S. PATENT DOCUMENTS

| | | | |
|---|---|---|---|
| 3,090,928 | 5/1963 | Welty | 342/375 |
| 3,766,558 | 10/1973 | Kuechken | 342/375 |
| 5,861,845 | 1/1999 | Lee et al. | 342/375 |

*Primary Examiner*—Gregory C. Issing

*Attorney, Agent, or Firm*—V. D. Duraiswamy; M. W. Sales

[57] ABSTRACT

Antenna structures are provided which facilitate the simultaneous radiation of multiple antenna beams. The structures include photonic manifolds that define equal-length optical paths and other optical paths whose lengths progressively change by a selected length ΔL. The manifolds conduct signal pairs to radiative modules. Each signal pair includes a frequency-swept scanning signal $s_s$ and a reference signal $s_r$ whose frequency is a selected one of the sum and the difference of the frequencies of the scanning signal $s_s$ and a respective operating signal $s_o$. Subsequently, the scanning signals are mixed with the reference signals and filtered to recover phase-shifted versions of each respective operating signal $s_o$. The phase-shifted versions are radiated to form multiple radiated beams wherein each beam is scanned by changing the frequency of its respective scanning signal $s_s$. The frequency of the scanning signals is selected to avoid generation of spurious radiated signals. This selection includes choosing the scanning signals so that each has a different integer number of 2π phase shifts over the path length ΔL. Methods of the invention permit the use of a common mixer and a common filter at each radiative module for processing all signal pairs.

20 Claims, 8 Drawing Sheets

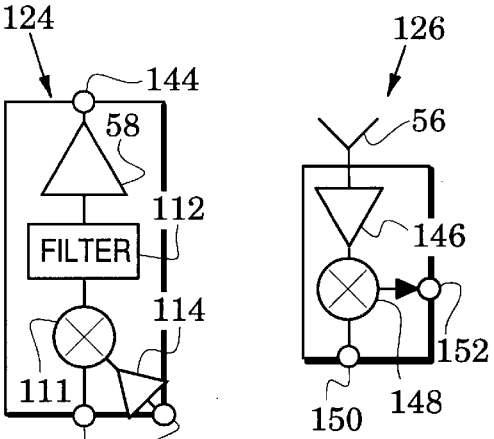
FIG. 6B
FIG. 6C
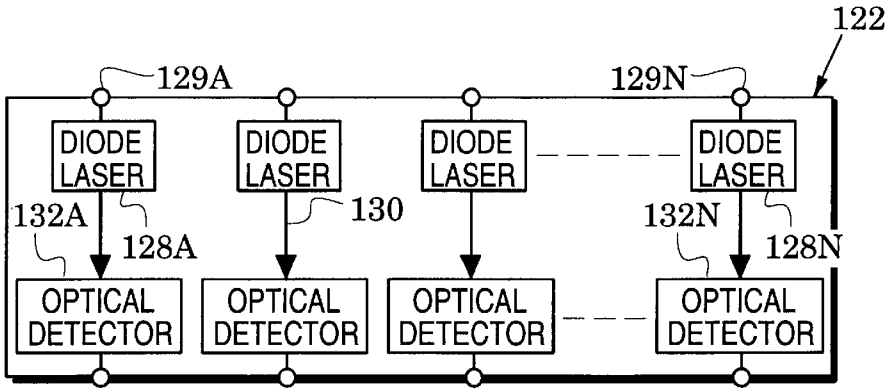
FIG. 6A
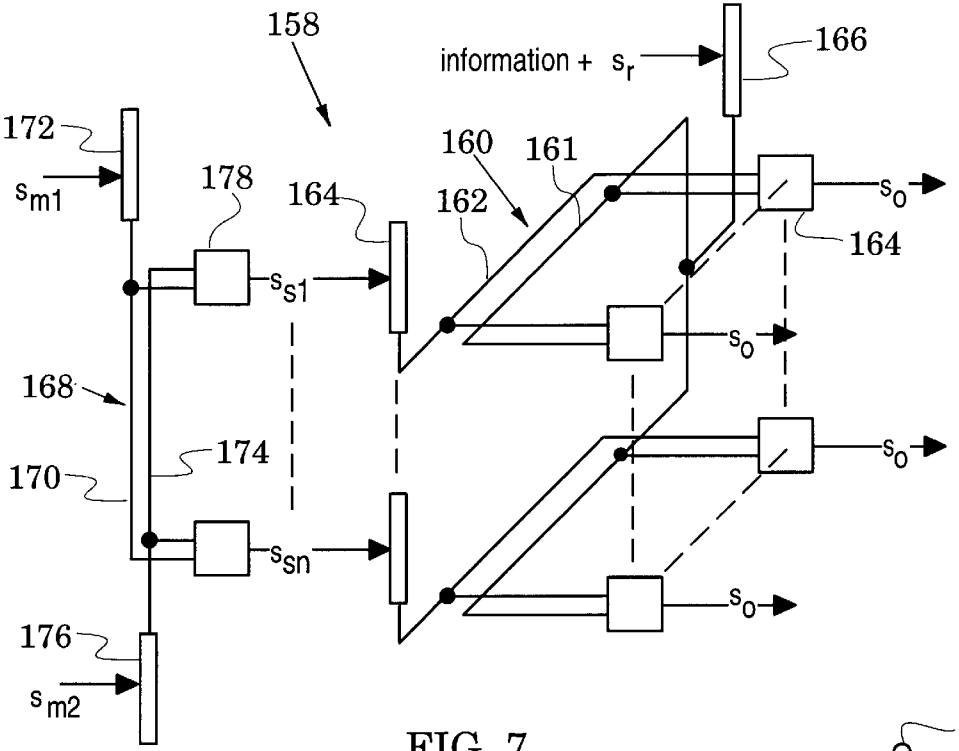
FIG. 7

240

| Two Beam Solutions (m) | | | Three Beam Solutions (m) |
|---|---|---|---|
| $s_0=s_r-s_s$ Branch | $s_0=s_s-s_r$ Branch | Mixed Branch | Mixed Branch |
| 6 & 8 | -11 & -13 | 6 & -11, 6 & -12 | 8 & -12 & -14 |
| 7 & 9 | -12 & -14 | 7 & -12, 7 & -13 | |
| 6 & 9 | -11 & -14 | 8 & -12, 8 & -13, 8 & -14 | |
| | | 9 & -13, 9 & -14 | |

MULTIBEAM PHASED ARRAY ANTENNAS AND METHODS

BACKGROUND OF THE INVENTION

1. Field of the Invention

The present invention relates generally to antennas and more particularly to phased array antennas.

2. Description of the Related Art

The antenna beam of a phased array antenna points in a direction that is normal to its phase front. In one conventional type of antenna, a plurality of phase shifters are incorporated in the array so that the phase front can be steered as desired. In another conventional type of antenna, beam-steering phase shifts are realized by varying the frequency of signals that are transmitted through time delay elements. This latter process scans the antenna beam but typically has the disadvantage that the frequency of the radiated beam is dependant upon the beam's pointing direction.

In contrast, U.S. Pat. No. 3,090,928 (issued May 21, 1963 in the name of William R. Welty) described the use of two time delay elements (e.g., tapped delay lines) to realize beam steering with a constant radiated frequency. In this patent, a reference signal is sent down one delay line and a tuning signal is sent down the other delay line. Corresponding tap points on the delay lines are coupled to mixers and the mixer outputs are coupled through filters to array radiators. The filters are configured to pass a desired mixing product (e.g., a difference signal) and block the reference and tuning signals.

U.S. patent application Ser. No. 08/711,428 (entitled "Simultaneous Multibeam and Frequency Active Photonic Array Radar Apparatus" and filed Sep. 5, 1996) is directed to active array systems that process multiple beams over a wide frequency range. It replaces conventional electronic radio-frequency (RF) delay lines (e.g., those of U.S. Pat. No. 3,090,928) with fiber optic delay lines. The delay lines provide a wide operating frequency range and the ability to process different RF signals through the use of light signals that have different wavelengths. Accordingly, an RF signal that is modulated on one light carrier does not interact with another RF signal that is modulated on a second light carrier. The RF signals may be placed on and taken out of the fiber delay lines using optical filtering (e.g., wavelength division multiplexing) of different light carriers.

A basic transmit manifold is described which has RF oscillators that generate a tuning frequency and a signal frequency. The transmit manifold also includes a solid state light source and electro-optic modulators that are coupled to an input of an optical manifold which is formed by a plurality of optical fibers. The output of this optical manifold is connected through photodiode detectors to array radiators of which each includes a series combination of a mixer, a filter and an RF amplifier.

A transmit implementation is shown that can provide two transmitted beams. With the exception of the optical manifold, this implementation duplicates all of the above-recited structures. In addition, pairs of wavelength division multiplexing (WDM) devices interface the optical manifold to the other structures. Accordingly, an active array system with multiple radiated beams can be realized but only at the expense of multiple duplications of photonic and electronic modules. It is stated that this duplication minimizes unwanted mixing products. However, this duplication also causes significant increases in size, weight and cost of the active array system.

SUMMARY OF THE INVENTION

The present invention is directed to multibeam phased array antennas that require significantly less antenna structures and elements than conventional antennas.

These goals are realized with a signal generator, first and second signal combiners, an array of radiative modules and first and second photonic manifolds that couple the signal combiners and the array.

The signal generator supplies m signal pairs that each include a respective frequency-swept scanning signal $s_s$ and a respective reference signal $s_r$ whose frequency is a selected one of the sum and the difference of the frequencies of the scanning signal $s_s$ and a respective operating signal $s_o$.

The first photonic manifold forms n optical paths whose lengths progressively increase by a selected path length $\Delta L$ and the second photonic manifold forms n equal-length optical paths. The first signal combiner combines all scanning signals $s_s$ and delivers them to the first photonic manifold. Similarly, the second signal combiner combines all reference signals $s_r$ and delivers them to the second photonic manifold.

Each of n radiative modules includes a mixer, a filter and a radiator. Each mixer receives scanning signals and reference signals from the photonic manifolds and forms a set of mixed signals. Each filter recovers a phase-shifted version of the respective operating signal $s_o$ of each signal pair. Each radiator then radiates the phase-shifted versions to form m radiated beams.

Methods of the invention avoid the generation of spurious radiated signals so that all signal pairs can be mixed and filtered in common mixers and filters of each radiative module. In addition, all scanning signals are carried by a common light carrier signal and all reference signals are carried by another common light carrier signal. Thus, a significant reduction of the device count and cost of multibeam phased array antennas is realized. The methods include the step of selecting the scanning signals of the signal pairs to each have a different integer number of $2\pi$ phase shifts over the path length $\Delta L$. In addition, the integer numbers are chosen so that scanning signals and reference signals of different signal pairs form mixing products that can be rejected by the filters of each radiative module.

Other antenna embodiments translate the photonic manifolds to lower intermediate frequencies to enhance the availability and lower the cost of components, reduce the precision required in cutting of optical fibers and realize a standard module that can be used in forming various multibeam phased array antennas.

The novel features of the invention are set forth with particularity in the appended claims. The invention will be best understood from the following description when read in conjunction with the accompanying drawings.

BRIEF DESCRIPTION OF THE DRAWINGS

FIG. 6A is a block diagram of a another photonic manifold in the antenna of FIG. 5;

FIGS. 6B and 6C are block diagrams of upconverter and downconverter modules in the antenna of FIG. 5;

FIG. 7 is a isometric view of a photonic manifold which extends photonic manifolds of the antennas of FIGS. 1, 3 and 5 to two-dimensions;

DETAILED DESCRIPTION OF THE PREFERRED EMBODIMENTS

Figure 1:
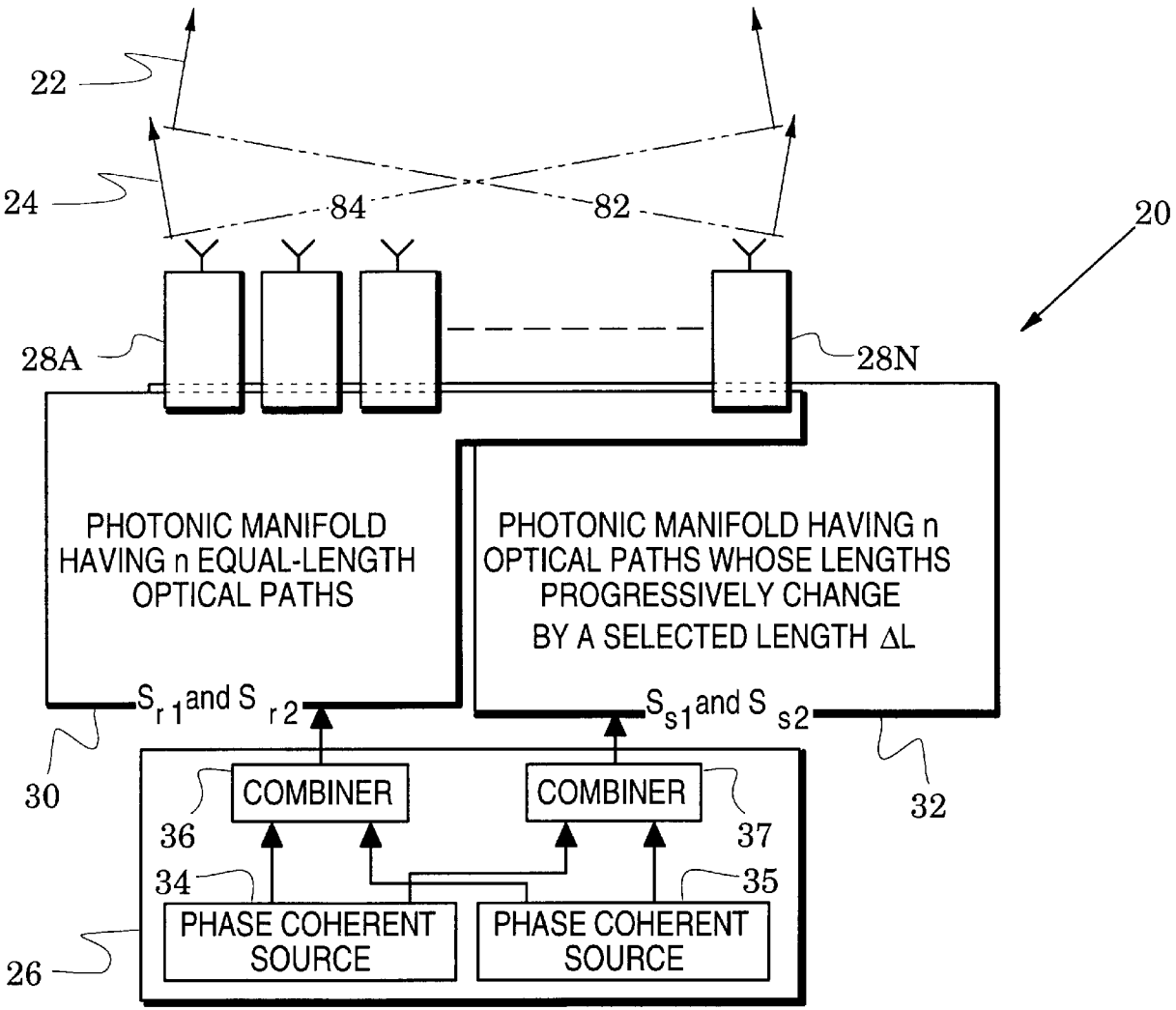
FIG. 1 is a block diagram of a multibeam phased array antenna of the present invention.

FIG. 1 illustrates a multibeam phased array antenna 20 which generates two independently-controlled antenna beams 22 and 24. The antenna includes an electronic signal generator 26 and a plurality of radiative modules 28A–28N. These antenna elements are coupled together by first and second photonic manifolds 30 and 32. An operational description of the antenna 20 is enhanced by preceding it with the following detailed description of antenna elements.

The electronic signal generator 26 has two phase coherent sources 34 and 35 that each generate a signal pair. Each signal pair comprises a frequency-swept scanning signal $s_s$ and a reference signal $s_r$ whose frequency is either the sum or the difference of the frequencies of the scanning signal $s_s$ and a fixed-frequency operating signal $s_o$. Thus, the first coherent source 34 generates signals $s_{s1}$ and $s_{r1}$ and the second coherent source 35 generates signals $s_{s2}$ and $s_{r2}$. The reference signals $s_{r1}$ and $s_{r2}$ are coupled through a first combiner 36 to the first photonic manifold 30. Similarly, the scanning signals $s_{s1}$ and $s_{s2}$ are coupled through a second combiner 37 to the second photonic manifold 32.

Figure 2C:
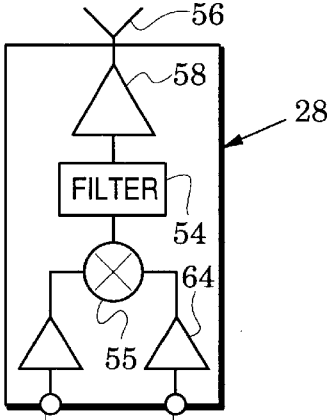
FIG. 2C is block diagram of a radiative module in the antenna of FIG. 1.
Figure 2E:
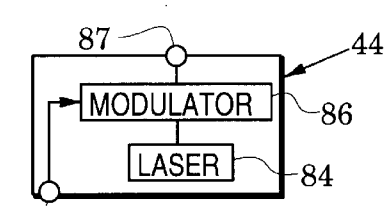
FIG. 2E is a block diagram of an optical signal generator in the photonic manifolds of FIGS. 2A and 2B.
Figure 2B:
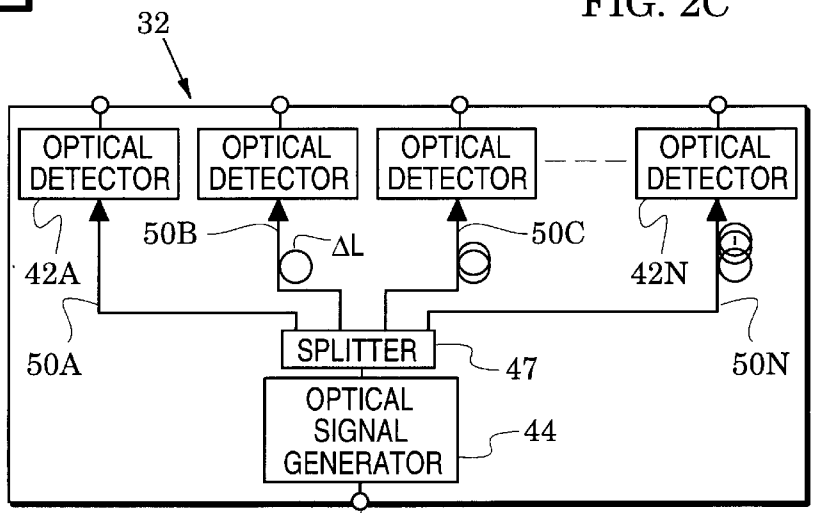
FIGS. 2A and 2B are block diagrams of first and second photonic manifolds in the antenna of FIG. 1.
Figure 2A:
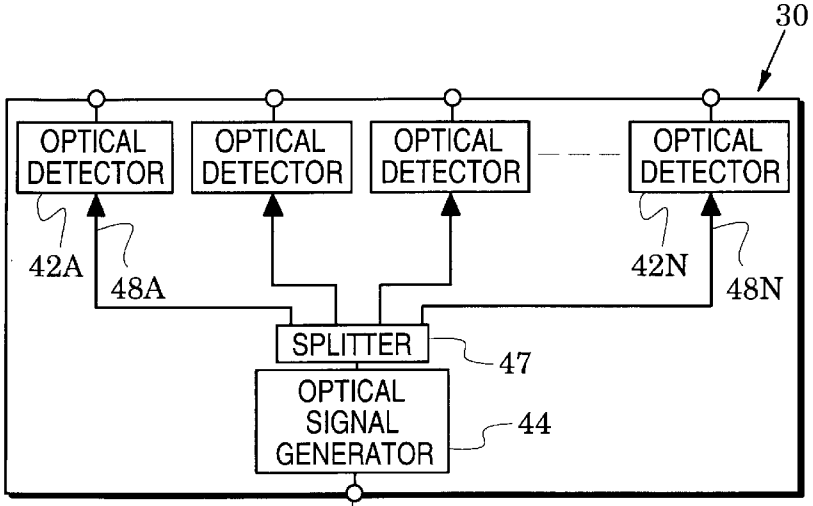

FIG. 2A shows that the first photonic manifold 30 has a plurality of optical detectors 42A–42N and a modulated optical signal generator 44 which has a modulation input port 45. The detectors 42 and the generator 44 are coupled together by an optical splitter 47 and a plurality of equal-length optical paths. In the antenna 20, these paths are realized with optical waveguides in the form of optical fibers 48A–48N. FIG. 2B shows that the second photonic manifold 32 also has a plurality of optical detectors 42 and an optical signal generator 44 but they are coupled together by an optical splitter 47 and progressive-length optical paths that are realized with optical waveguides in the form of optical fibers 50A–50N. In particular, the lengths of the optical fibers 50 progressively change by a selected length ΔL (e.g., fiber 50B is longer than fiber 50A by ΔL, fiber 50C is longer than fiber 50B by ΔL and so on). Accordingly, the phase slopes (in response to the swept-frequency scanning signal $s_s$) of the fibers 50 progressively change by a selected slope increment.

In FIG. 2C, each radiative module 28 includes a filter 54 that is coupled between a mixer 55 and a radiator 56 (e.g., a horn, a slot or a flared notch). The output of the mixer is preferably amplified by a transmit amplifier 58 and the inputs 60 and 62 of the module are preferably amplified by buffer amplifiers 64. In FIG. 1, the input 60 of each radiative module 28A–28N is coupled to a respective one of the equal-length optical fibers 48A–48 of the photonic manifold 30 and the input 62 is coupled to a respective one of the progressive-length optical fibers 50A–50N of the photonic manifold 32. These connections are symbolized by indicated overlaps of the antenna elements 28A–28N, 30 and 32. To facilitate fabrication and assembly processes, the optical detectors 42A–42N may actually reside in respective ones of the radiative modules 28A–28N.

Figure 2D:
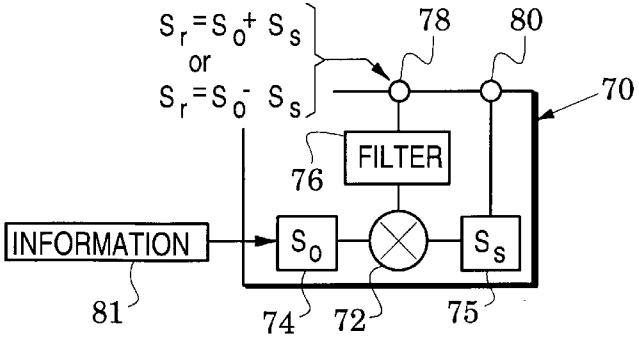
FIG. 2D is a block diagram of a phase coherent source in the antenna of FIG. 1.

The phase coherent sources 34 and 35 can be formed by various structures that can generate the coherent signals $s_r$ and $ss_s$. An exemplary structure 70 is shown in FIG. 2D to have a mixer 72 coupled between signal generators 74 and 75 that respectively generate the fixed-frequency operating signal $s_o$ and the swept-frequency scanning signal $s_s$. A filter 76 connects the mixer to an output port 78. The filter is configured to pass a selected one of the sum and difference of the operating signal $s_o$ and the scanning signal $s_s$.

This passed signal is the reference signal $s_r$ and it is available at the output port 78. The scanning signal $s_s$ is made available at another output port 80. In FIG. 1, the output ports 78 and 80 are respectively connected to the combiners 36 and 37. Information (e.g., analog or digital data applied by amplitude, phase or frequency modulation) can be placed on the operating signal by an information source 81.

The optical signal generators 44 of FIGS. 2A and 2B can be any of a variety of modulatable generators. As a first example, the generators are directly modulated diode lasers. As a second example, the generators are each a laser 84 that is connected through a modulator 86 (e.g., a Mach-Zehnder electro-optic modulator) to an output port 87 as shown in FIG. 2E.

In operation of the antenna 20 of FIG. 1, the radiative modules 28A–28N are configured to radiate the operating signal $s_o$ that is associated with the phase coherent sources 34 and 35.

For example, if the filter 76 of the phase coherent source 70 of FIG. 2D is configured to pass a reference signal $s_r$ that is the sum of the operating signal $s_o$ and the scanning signal $s_s$, then the filter 54 of the radiative module 28 of FIG. 2C is configured to pass the difference of the reference signal $s_r$ and the scanning signal $s_s$ (i.e., the operating signal $s_o$). Alternatively, if the filter 76 is configured to pass a reference signal $s_r$ that is the difference of the operating signal $s_o$ and the scanning signal $ss_s$ then the filter 54 is configured to pass the sum of the reference signal $s_r$ and the scanning signal $s_s$ (i.e., the operating signal $s_o$).

Because of the phase coherent sources 34 and 35, the frequency of each reference signal will scan oppositely from the frequency of its respective scanning signal and the frequency of the associated operating signal will be constant. However, the photonic manifold 32 imposes a progressive phase shift on the scanning signals of the radiative modules 28A–28N. Accordingly, the radiated operating signals $s_o$ also have a progressive phase shift which generates a linear phase front in the radiated signals. Because the optical fibers 50A–50N have a progressive length change of $\Delta L$, the progressive phase shift increases with increasing frequency of the scanning signal.

Thus, changing the frequency of the scanning signal $s_{s1}$ changes the slope of the phase front 82 of radiated antenna beam 22 and changing the frequency of the scanning signal $s_{s2}$ changes the slope of the phase front 84 of radiated antenna beam 24. Thus, the beams 22 and 24 can be independently scanned.

Space at the face of phased array antennas is typically quite limited. For example, in order to scan the beams 22 and 24 over 90° scan angles without generation of secondary beams (commonly called grating lobes), the spacing of the radiative modules 28A–28N in FIG. 1 must not exceed $\lambda_o/2$ wherein $\lambda_o$ is the wavelength of the operating signal $s_o$. The arrangement of the antenna 20 permits all structures but the optical detectors 42A–42N of FIG. 2A to be spaced away from the array of radiative modules 28A–28N.

Although the antenna teachings of the invention are illustrated in FIGS. 1–2E with reference to simultaneous generation of two antenna beams 82 and 84, the teachings apply in general to the generation of n antenna beams. In the electronic signal source 26 of FIG. 1, generation of n signal pairs (each pair being a reference signal $s_r$ and its corresponding scanning signal $s_s$) requires two combiners and n phase coherent sources. In an important feature of the invention, however, no other additional antenna structure need be added to that required for generation of a single antenna beam.

In particular, each signal pair generates one of n antenna beams and all signal pairs are carried by one equal-length photonic manifold and one progressive-length photonic manifold. In each radiative module of the array, all signal pairs are mixed and filtered in a single mixer and filter before being applied to an array radiator. In comparison to conventional phase array antennas, therefore, antennas of the invention can be realized with a substantial savings in parts, assembly time and cost.

Because all signal pairs are mixed and filtered in the same mixer and filter at each array element, special methods are required to assure spurious-free operating signals $s_o$. A description of these methods is preceded by the following description of other antenna embodiments.

Figure 3:
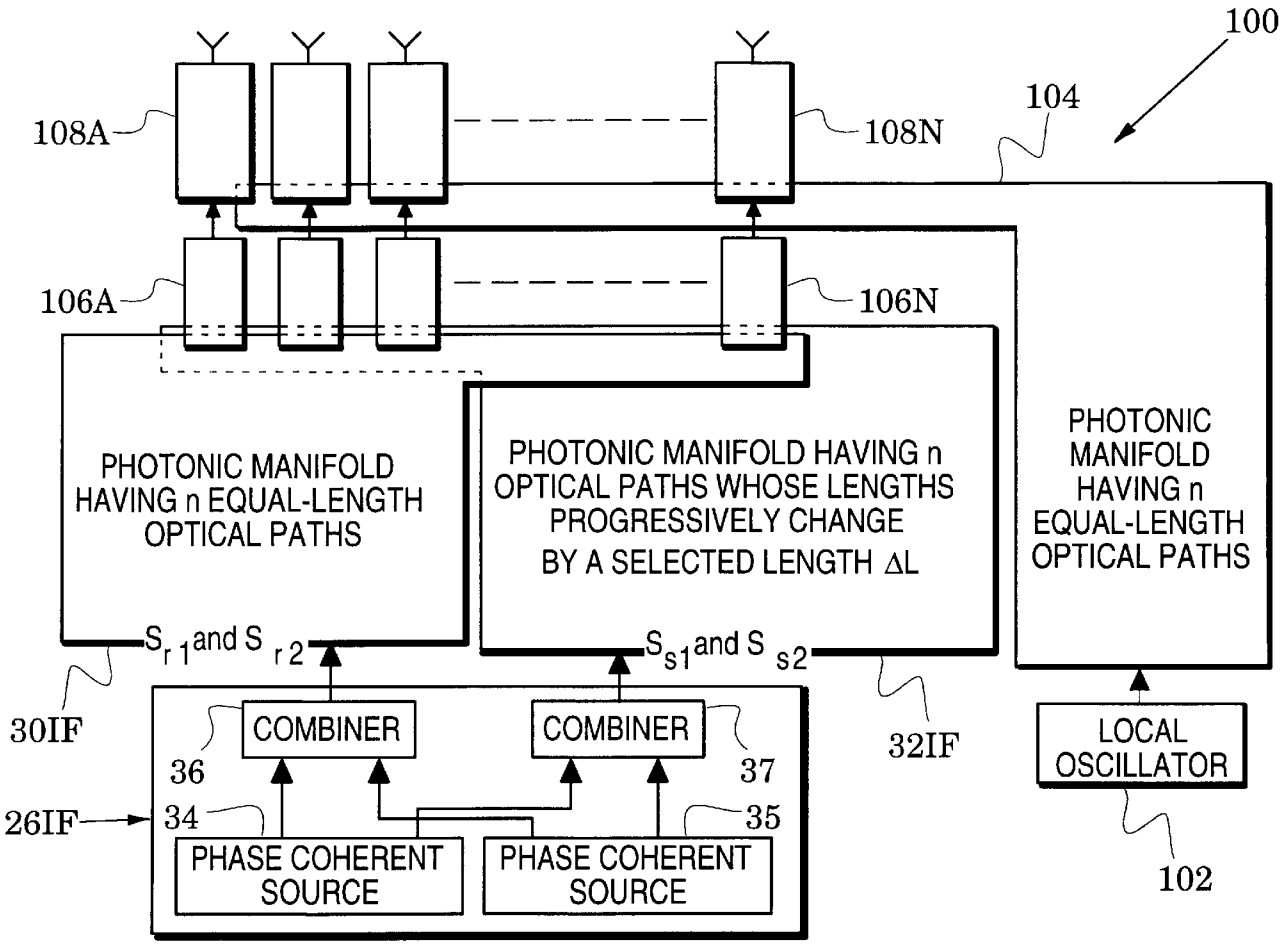
FIG. 3 is a block diagram of another multibeam phased array antenna.

FIG. 3 illustrates another phased array antenna 100 in which portions are similar to the antenna 20 of FIG. 1 with like elements indicated by like reference numbers. However, the antenna 100 has a local oscillator 102 and a third photonic manifold 104. In addition, each radiative module 28 of FIG. 1 has been partitioned between a mixer module 106 and an upconverter module 108 as shown respectively in FIGS. 4A and 4B.

In particular, the mixer module 106 is the same as the radiative module 28 except that its power amplifier 58 and radiator 56 have been removed and repositioned at the output of the upconverter module 108. In their place the mixer module 106 has an amplifier 107 and an output port 109. The upconverter module also arranges an input port 110, a mixer 111 and a filter 112 in series with the radiator 56. An amplifier 114 connects an upconverter port 116 to the mixer 111. In the antenna 100, output ports 109 of mixer modules 106A–106N are connected to input ports 110 of respective ones of upconverter modules 108A–108N. Basically, the antenna 100 adds a signal upconverter between the mixer 55 and radiator 56 of the radiative module 28 of FIG. 2C.

The third photonic manifold 104 is substantially the same as the first photonic manifold, i.e., it has equal-length optical fibers connecting a plurality of optical detectors to an optical signal generator. The optical detectors of this module are closely associated with the upconverter modules 108A–108N as indicated in FIG. 3 by the overlap between these modules and the third photonic manifold 104.

The operation of the antenna 100 is similar to that of the antenna 20 but, in addition, the equal-length manifold 104 couples upconverter signals from the local oscillator 102 to upconverter modules 108A–108N. Because of the equal-length optical paths of the third photonic manifold 104, these upconverter signals are in-phase and the phase fronts 82 and 84 of FIG. 1 are not disturbed.

However, the upconverter signals permit the antenna 100 to radiate multiple microwave beams in a desired microwave frequency (e.g., X-band) while translating the operational frequency of the first and second photonic manifolds 30 and 32 and the electronic signal generator 26 downward to a lower frequency (e.g., 2.5–3 GHz). Lowering the operating frequency of optical generators and detectors significantly increases their availability and lowers their cost. Accordingly, the photonic manifolds 30 and 32 and the electronic signal generator 26 of FIG. 1 have been renumbered as 30IF, 32IF and 26IF to indicate they operate at intermediate frequencies which are translated downward from corresponding frequencies in the antenna 20 of FIG. 1.

A lower operating frequency also eases fabrication difficulties because it lessens the precision needed in cutting the optical fibers 48A–48N and 50A–50N of the manifolds 30 and 32. Accordingly, the structure of the antenna 100 significantly enhances its producibility.

Figure 5:
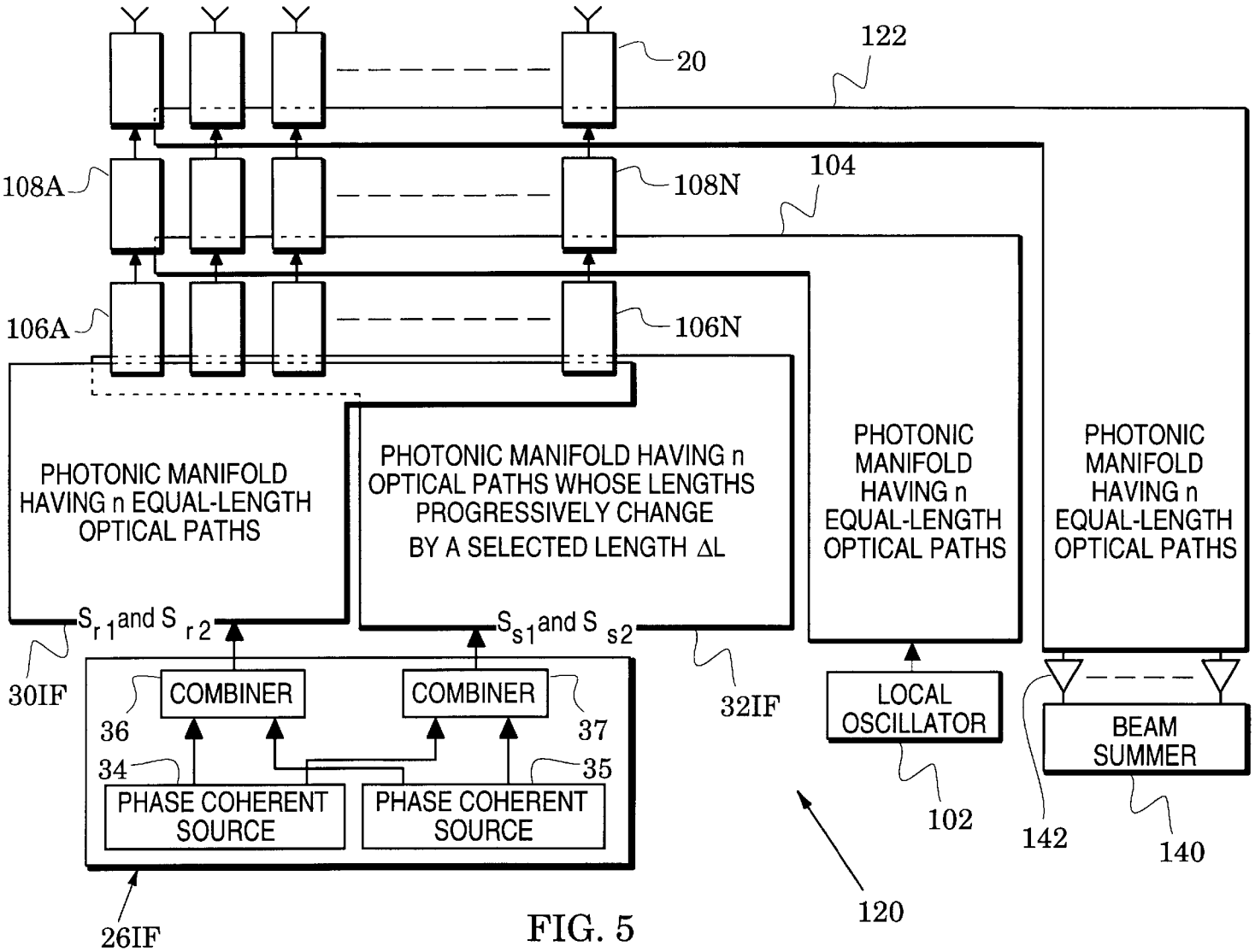
FIG. 5 is a block diagram of another multibeam phased array antenna.

FIG. 5 illustrates another phased array antenna 120 in which portions are similar to the antenna 20 of FIG. 1 with like elements indicated by like reference numbers. In contrast, however, the antenna 120 has a fourth photonic manifold 122 and the upconverter module 108 of FIG. 3 has been partitioned between an upconverter module 124 and a downconverter module 126 as shown in FIGS. 6B and 6C. In particular, the fourth photonic manifold 122 of FIG. 6A has a plurality of optical generators 128A–128N with modulation inputs 129A–129N (e.g., directly modulated diode lasers) that are each coupled through equal-length optical fibers 130 to a respective one of a plurality of optical detectors 132A–132N. A beam summer 140 receives inputs through amplifiers 142 from the optical detectors 132A–132N.

Figure 4A:
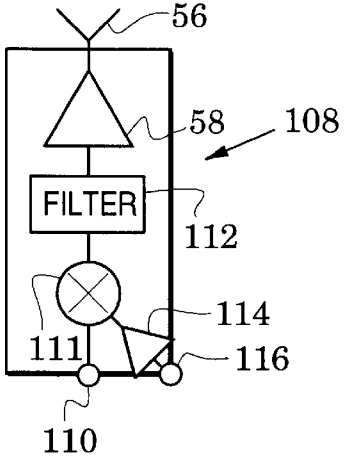
FIGS. 4A and 4B are block diagrams of mixer and upconverter modules in the antenna of FIG. 3.
Figure 4B:
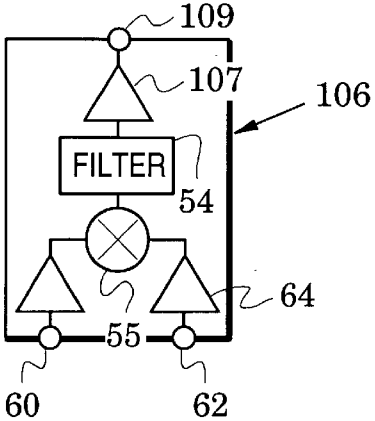

The upconverter 124 of FIG. 6B is the same as the upconverter 108 of FIG. 4A except that the radiator 56 has been replaced by an output port 144 and the radiator has been moved to the output of the downconverter module 126 of FIG. 6C. In addition, the latter module has a low-noise amplifier 146 and a mixer 148 serially coupling the radiator 56 to an input port 150. The mixer 148 has an output port 152.

In the antenna 120, the output port 144 of each upconverter module 124 is coupled to the input port 150 of a respective downconverter module 126 and the output port 152 of each downconverter module is connected to a respective modulation input 129 of the manifold 122.

Operation of the antenna 120 is similar to that of the antenna 100 but, in addition, the antenna 120 illustrates an exemplary receive structure in which the phase front of an incoming antenna beam is mixed with at least a sample of the transmitted signal to produce a properly-phased receive signal. This receive signal is transported via the photonic manifold 122 to a remotely-located beam summer 140. Because the elements of the manifold 122 operate at a much lower frequency, their availability and cost are significantly improved.

The concepts of the antennas of FIGS. 1–5C can be extended to two-dimensional scanning. For example, FIG. 7 schematically illustrates a two-dimensional manifold system 158. It includes horizontal manifold rows 160. Each of these rows is formed with a reference manifold 161 and a scanning manifold 162 that are respectively similar to the first and second photonic manifolds 30 and 32 of FIG. 1. That is, each manifold 161 has equal-length optical paths and each manifold 162 has progressive-length optical paths. The horizontal manifold rows 160 feed a two-dimensional array of optical detectors which is represented at each array corner by optical detectors 164 (similar to the detectors 42 of FIGS. 2A and 2B).

Rows of the equal-length manifold 161 are fed by an optical generator 166 that is modulated by a reference signal $s_r$ (information is typically carried on this signal). Each row of the manifold 162, however, is fed by a respective one of progressive-phase scanning signals $s_{s1}$—$s_{sn}$. The latter signals are generated in a vertical manifold 168 that is similar to the first and second manifolds 30 and 32, i.e., it has an equal-length manifold 170 fed by an optical generator 172 that is modulated with a first mixing signal $s_{m1}$ and a progressive-length manifold 174 fed by an optical generator that is modulated with a second mixing signal $s_{m2}$. These mixing signals are chosen so that a selected mixing product of them yields a scanning signal $ss_s$. The signals of the vertical manifold 168 are then detected, mixed and filtered in modules 178 to generate the progressive-phase scanning signals $s_{s1}$—$s_{sn}$.

Figure 8:
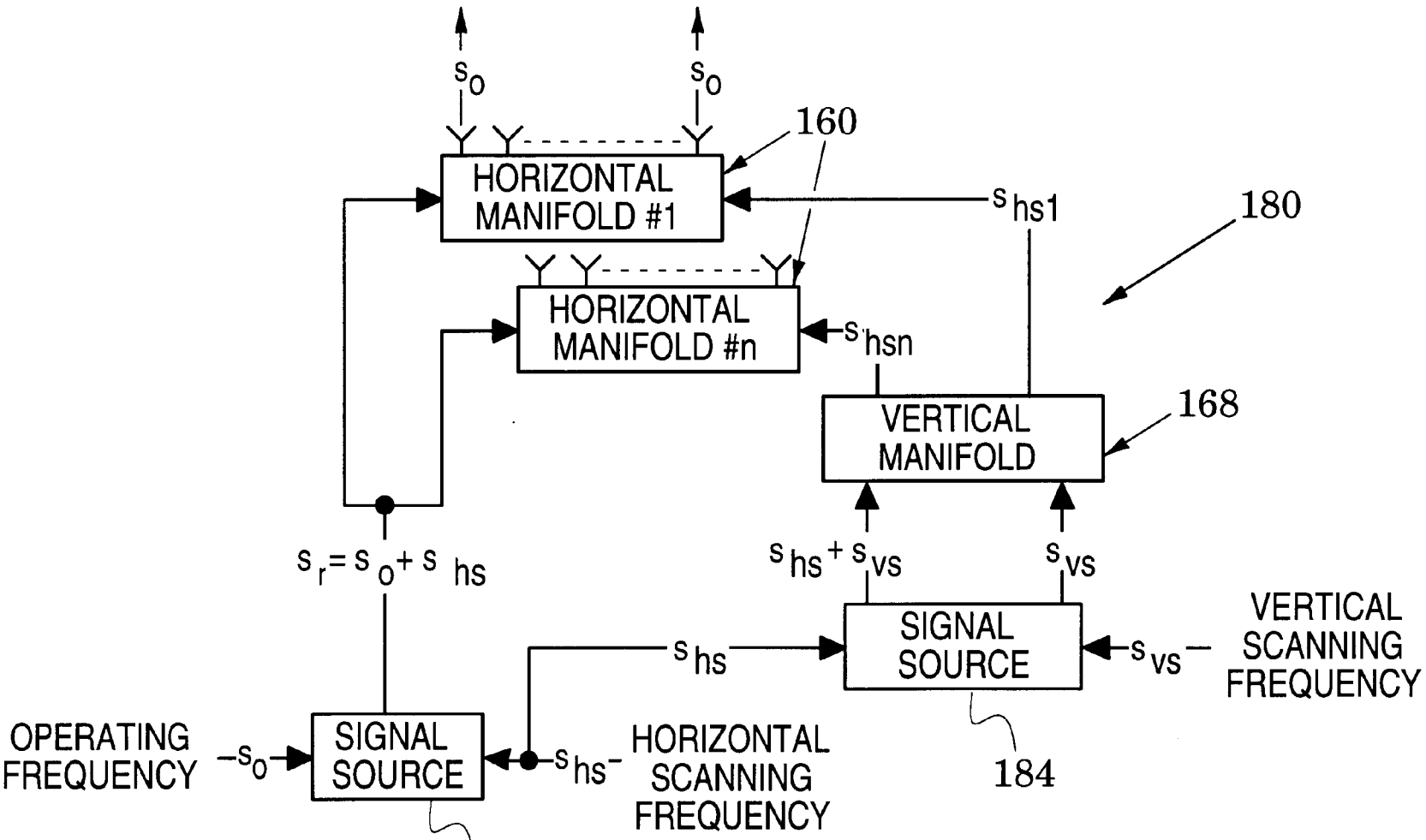
FIG. 8 is a block diagram of an electronic signal generator in the photonic manifold of FIG. 7.

FIG. 8 illustrates a system 180 of electronic signal generators that can generate reference, scanning and operational signals in the manifold system 158 of FIG. 7. The system is shown with reference to the horizontal manifold rows 160 and the vertical manifold 168 of FIG. 7. The system includes horizontal and vertical electronic signal generators 182 and 184 which are similar to the generator 70 of FIG. 2D.

In operation of the system 180, an operating signal $s_o$ is applied to the signal source 182, a vertical scanning signal $s_{vs}$ is applied to the signal source 184 and a horizontal scanning signal $s_{hs}$ is applied to the signal sources 182 and 184. The signal source 182 generates a sum signal $s_o+s_{hs}$ which is applied to the equal-length horizontal manifold rows 160 and the horizontal scanning signal $s_{hs}$ is applied to the signal source 184. The signal source 184 generates a sum signal $s_{hs}+s_{vs}$ and the vertical scanning signal which are respectively applied to equal-length and progressive-length portions of the vertical manifold 168. In response, the vertical manifold applies progressive-phase scanning signals $s_{hs1}-s_{hsn}$. to the horizontal manifold 160. Finally, the horizontal manifold radiates operating signals $s_o$ which are the difference between the signals applied to the horizontal manifold. The generating concepts illustrated in FIG. 8 can be readily extended to the generation of multiple signal sets (of reference and scanning signals) as in the electronic signal generator 26 of FIG. 1.

Phased array antennas of the invention are particularly suited for radiation and reception of independently-scanned multiple signal beams. As shown in FIG. 1 for a two-beam example, two signal pairs are applied to the radiative modules 28A–28N wherein each signal pair consists of a reference signal and a scan signal. In accordance with a feature of the invention all of these signals are carried on single sets of photonic manifolds (e.g., the manifolds 30 and 32 of FIG. 1) and mixed and filtered in single sets of radiative modules (e.g., in the mixer 55 and filter 54 of FIG. 2C). That is, multibeam phased arrays are realized with structures that have conventionally been considered sufficient only for single beam operation.

This multibeam operation is facilitated by methods of the invention which can select solutions of system equations. These include the following equations, $$\text{output frequency: } f_o=f_r\pm f_s \tag{1}$$

$$\text{inter—element phase: } \Delta\phi=\pm 2\pi\Delta L f_s/v \tag{2}$$

$$\text{scan angle: } \sin\theta = \frac{c}{v}\frac{\Delta L}{D}\frac{f_s}{f_o} - \frac{m\lambda_o}{D} \quad m=0,\pm 1,\pm 2-- \tag{3}$$

$$\text{beam squint: } \frac{d\theta}{df_o} = \frac{c}{Df_o^2\cos\theta}\left(\pm\frac{\Delta L f_s}{v}+m\right) \tag{4}$$

in which D is the spacing between radiators (56 in FIG. 2C) at the array face, $\lambda_o$ is the free space wavelength, c and v are light velocities in free space and in optical fiber and m is an integer. In particular, m is the number of $2\pi$ phase shifts at the frequency of the scanning signal $s_s$ in the delta fiber length $\Delta L$ that is used to form the progressive-length manifolds of the invention. For example, if the frequency of a scanning signal $s_s$ is set so as to place its respective radiated beam on boresight (e.g., causing one of the phase fronts 82 and 84 to be horizontal in FIG. 1), the insertion of any integer number of $2\pi$ it phase shifts would still cause the beam to be on boresight. The beam squint of equation (4) represents beam widening that results, for example, when the bandwidth of the reference signal $s_r$ is expanded by information that it carries (e.g., pulses).

In arrays, the array element spacing D is generally selected to insure that grating lobes are not generated in a selected scan angle θ that a system is designed to achieve. In an exemplary system in which the antenna beams are intended to scan ±90°, it is known that grating lobes will not occur in this region if $D\leqq\lambda_o/2$. For simplicity of description, it is assumed in the following discussion that $D=\lambda_o/2$.

Figure 9:
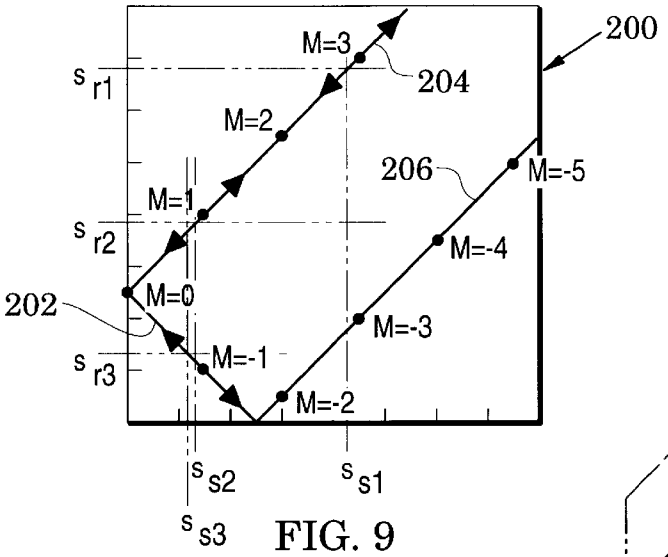
FIG. 9 is a diagram of a signal space that is relevant to operation of the antenna of FIG. 1.

FIG. 9 shows a signal space 200 defined by the reference and scanning signals $s_r$ and $s_s$. In this space it is further assumed that the frequency of the operating signal $s_o$ is constant and the bandwidth is very narrow (i.e., a narrow bandpass filter is used for the filter 54 of FIG. 2C).

If the operating signal is generated as $s_o=s_r+s_s$, then the sum branch 202 represents the locus of the operating signal $s_o$. If the operating signal is generated as $s_o=s_r-s_s$, then the difference branch 204 represents the locus of the operating signal and if the operating signal is generated as $s_o=s_s-s_r$, then the difference branch 206 represents the locus of the operating signal.

Various values of m are indicated on the branches 202, 204 and 206. In accordance with equation (2), these values represent the number of $2\pi$ phase shifts of a scanning signal $s_s$ in the delta fiber length $\Delta L$. At m=3 in the difference branch 204, for example, that frequency of a scanning signal $s_s$ will define three $2\pi$ phase shifts in a delta fiber length $\Delta L$ or, equivalently, between adjacent radiator modules 28 in FIG. 1. As the frequency of the scanning signal increases, the greater the number of $2\pi$ phase shifts between radiative modules and the greater the value of m.

An antenna beam will be formed if the corresponding reference signal is also adjusted to intersect the branch 204 at m=3 because this combination of reference and scanning signals selects an operating signal $s_o$ that is defined by the difference branch 204. Moving the frequency of the reference and scanning signals scans the respective beam over its selected scan angles. This scan is indicated in FIG. 9 by double-headed arrows about selected m values (about m=2 and 3 in difference branch 204 and about m=−1 in sum branch 202). The antenna beam is on boresight when the frequencies of the reference and scanning signals are on one of the solid circles that represent each value of m.

A first signal pair having a reference signal $s_{r1}$ and a scanning signal $s_{s1}$ is shown in FIG. 9 to operate in the m=3 region of the difference branch 204. A second signal pair having a reference signal $s_{r2}$ and a scanning signal $s_{s2}$ is shown to operate in the m=1 region. It is noted that the reference signal $s_{r1}$ does not intersect with the scanning signal $s_{s2}$ at any of the loci 202, 204 and 206. It is also noted that the reference signal $s_{r2}$ does not intersect with the scanning signal $s_{s1}$ at any of the loci. Thus, these selected signal pairs will generate two independently-scanned antenna beams and will not generate any spurious beams (because members of different signal pairs do not intersect on any operating signal locus).

A third signal pair having a reference signal $s_{r3}$ and a scanning signal $s_{s3}$ is shown in FIG. 9 to operate in the m=−1 region of the sum branch 202. It can be seen that the reference signal and the scanning signal also intersect in the m=1 region of the difference branch 204. Operating the antenna 20 of FIG. 1 with the first and second signal pairs could therefore generate a spurious beam. As shown by these examples, the methods of the invention (as symbolized by FIG. 9) facilitate the generation and radiation of spurious-free multiple beams.

Figure 11:
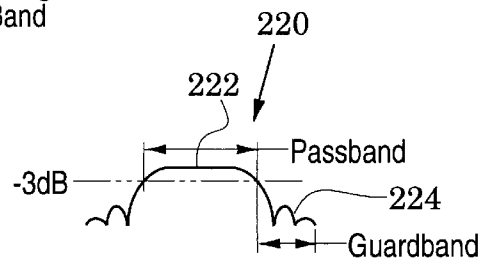
FIG. 11 is a diagram of a filter passband that is relevant to the signal space of FIG. 10.
Figure 10:
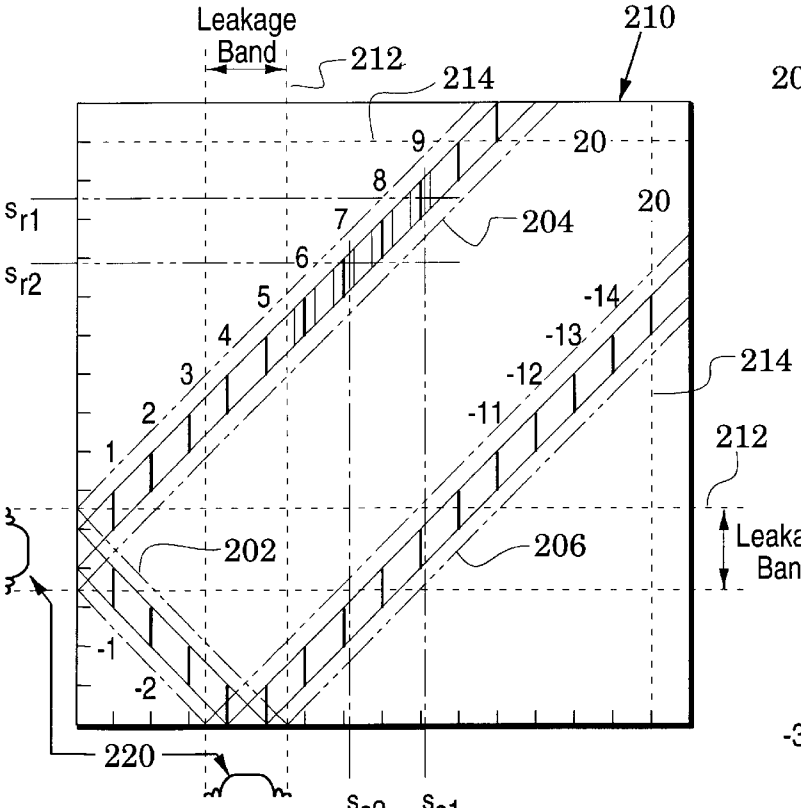
FIG. 10 is a more detailed diagram of the signal space of FIG. 9.

A more general view of the signal space 200 of FIG. 9 is shown by the signal space 210 of FIG. 10. This figure is similar to FIG. 9 with like elements indicated by like reference numbers. However, the effects of the mixing filter 54 of FIG. 2C are considered. This filter, of course, passes a selected operating signal $s_o$ which, in turn, was generated by mixing of the reference and scanning signals $s_r$ and $s_s$ in the mixer 54. An exemplary filter characteristic 220 is illustrated in FIG. 11 which indicates a pass band 222 and guard bands 224. This filter characteristic is repeated along the abscess and ordinate of the signal space 210 in FIG. 10.

Figure 12:
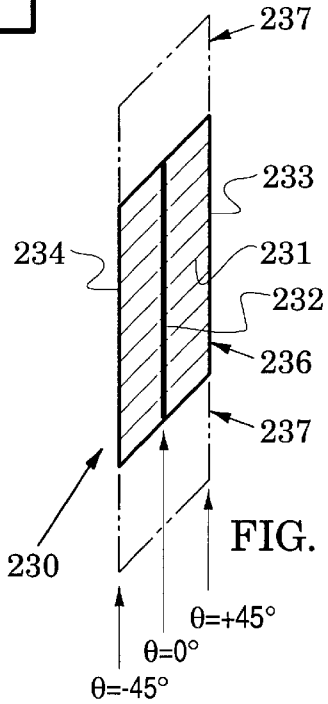
FIG. 12 is an enlarged view of an operating region in the diagram of FIG. 10.

FIG. 12 illustrates an enlarged view 230 of operating regions of FIG. 10. Slanted lines 231 in FIG. 12 indicate regions in which the operating signal $s_o$ has a constant frequency. As described above, varying a scanning frequency scans its corresponding beam across a scan angle (e.g., see FIG. 1). Thus, horizontal movement in FIG. 12 corresponds to varying scanning frequencies and varying beam scan angles. Exemplary boresight (θ=0°) and ±45° scan angles are shown respectively by vertical lines 232, 233 and 234.

Conversely, vertical movement in FIG. 12 corresponds to varying reference signal frequencies and resultant frequency changes in operating signal $s_o$. That is, vertical movement corresponds to operating bandwidth. It also corresponds to information bandwidth and to the passband and guard bands of the filter 220 of FIG. 11. If the information signal of FIG. 1 included pulses, the bandwidth of the exemplary filter 220 is preferably wide enough to transmit substantially all of the pulse's spectrum.

Region 236 in FIG. 12 corresponds to the passband 222 of the filter 220 of FIG. 11 and is shown in bold lines. Regions 237 in FIG. 12 correspond to the guard bands 224 and are shown in broken lines.

The operating region shown in FIG. 12 is repeated for selected operating points in FIG. 10. A first signal pair is shown in FIG. 10 as reference signal $s_{r1}$ and scanning signal $s_{s1}$ that intersect in the region of m=9. A second signal pair is shown as reference signal $s_{r2}$ and scanning signal $s_{s2}$ that intersect in the region of m=7. Because the reference signal of either of these pairs does not intersect with the scanning signal of the other of these pairs in an operating region represented by an m value, these signals will generate independently-scanned signals in the antenna 20 of FIG. 1 without the generation of spurious beams.

Inspection of FIGS. 9–12 leads to operating processes of the invention. First, it is seen that the operating regions of signal pairs (each pair being a reference signal $s_r$ and a corresponding scanning signal $s_s$) should be sufficiently spaced to avoid spurious operating regions. The two signal pairs of FIG. 10 meet this criterion because unwanted intersections are outside of any operating region and also outside of any guard band region.

Also, the operating regions of signal pairs should be above (in frequency) the areas corresponding to the passband and guardbands of the mixing filter 54 of FIG. 2C. This filter characteristic was shown in FIG. 11 and repeated along the abscissa and ordinate of the signal space 210 of FIG. 10. Extensions of these filter bands are indicated in broken lines 212 and the enclosed region labeled "leakage band". Observance of this rule assures that the signal pairs and their harmonics do not pass through the filter and produce spurious radiated signals.

In addition, it is observed that higher frequency operating regions are generally less prone to generation of spurious radiated signals. Operation at m=±2 regions would, for example, generate harmonics that would generate spurious signals in regions at m=±4, m=±6 and so on.

Operating regions must be below the frequency limits of electronic and photonic operational elements, e.g., that of optical detectors of FIGS. 2A and 2B. Exemplary upper operational limits 214 are shown in FIG. 10. Selected signal pairs must lie below these limits.

Because of these observations, it follows that multibeam operation is best conducted with signal pairs that operate on the difference branches 204 and 206, that are above region of the mixing filter 220, that are below the electrical and photonic operational limits and that are widely spaced. Table 240 of FIG. 13 lists signal pairs of FIG. 10 that meet the selection criteria outlined above. It is also apparent that narrowing the filter 220 characteristics of FIG. 11 and narrowing the beam scan angle in FIG. 12 enhances the chances of finding nonspurious operating signal pairs.

In addition, higher reference and scanning signal frequencies (e.g., ones that are two or three times greater than the frequency of the operating signal) typically enhances the chances of finding spurious-free operation regions.

Figures 13, 14:
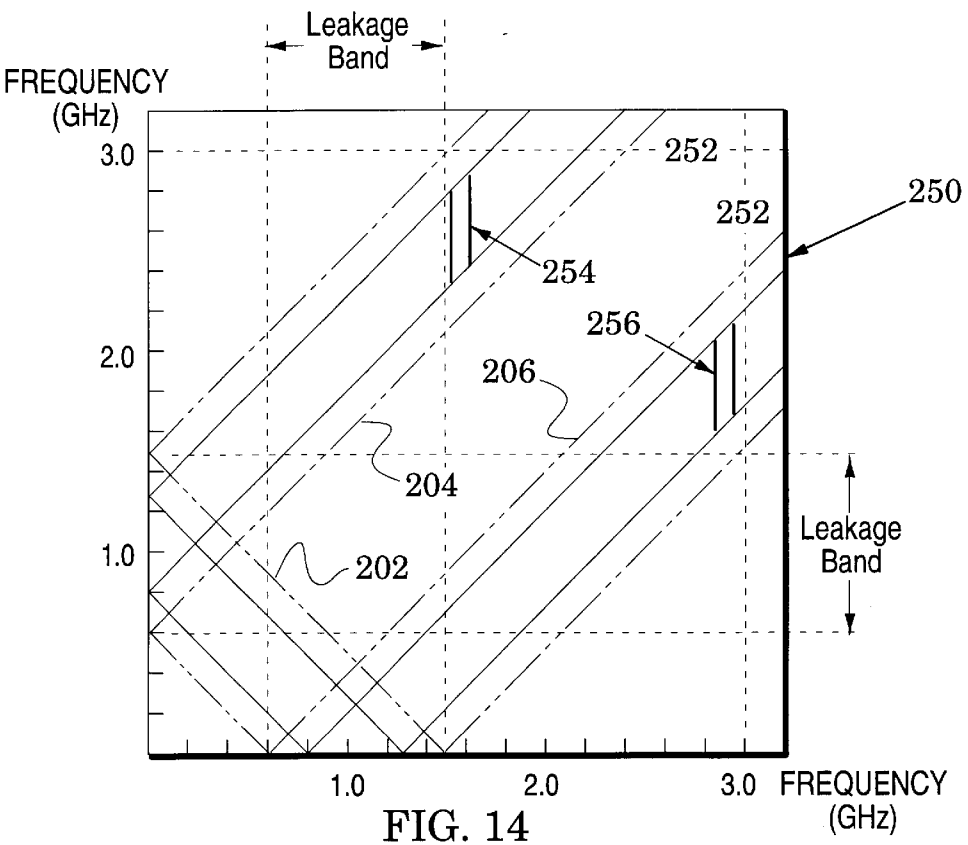
FIG. 13 is a table of nonspurious operating regions in the diagram of FIG. 10.
FIG. 14 is an diagram similar to that of FIG. 10 but relevant to the antennas of FIGS. 3 and 5.

FIG. 14 shows a diagram 250 that is similar to that of FIG. 10 but which is relevant to the antennas 100 and 120 of FIGS. 3 and 5. In particular, this diagram illustrates operating regions for the intermediate-frequency photonic manifolds 30IF and 32IF in the antennas 100 and 120 of FIGS. 3 and 5. In this figure, the bandwidth of the filter 54 of FIG. 2C has been established as 0.6–1.25 GHz and is labeled "leakage band". This filter has been assumed to have −40 dB response at 200 MHz from its passband edges so that the selected operating regions will yield spurious emissions that are greater than 40 dB below the antenna beams. An upper frequency limit for readily-available photonic devices (e.g., photodetectors and directly modulated diode lasers) is shown as limit 252 at ~3 GHz. Operating regions thus must be outside of the filter's leakage bands and less than the frequency limits 252.

Two nonspurious signal pairs have been selected—the first 254 operates in a region associated with m=16 in the difference branch 204 and the second 256 operates in a region associated with m=−29 in the difference branch 206. In this design, the delta fiber length ΔL has been selected as 204.78 centimeters, the intermediate-frequency of the operating signal is 0.8–1.3 GHz, the frequencies of a first signal pair are $s_{r1}$=2.36–2.95 GHz, $s_{s1}$=1.54–1.66 GHz and the frequencies of a second signal pair are $s_{r2}$=1.54–2.14 GHz, $s_{s2}$=2.84–2.96 GHz.

The intermediate-frequency signals can be up converted to X-band with transmit and receive bandwidth of 500 MHz. A local oscillator (102 in FIG. 3) can be set at 7.1 GHz so that transmission at the radiative modules (108 in FIG. 3) is in the 7.9–8.4 GHz band. In a feature of the invention, photonic manifolds and an associated electronic signal generator can be designed similar to the design of FIG. 14 and used as a "building block" in various phased array antennas.

It is seen, therefore, that the antenna 100 of FIG. 3 is particularly suited for translating the operation of the first and second photonic manifolds down to a frequency range which enhances the availability and cost of manifold devices. Similarly, the antenna 120 of FIG. 5 translates receive operations (e.g., beam summing and processing) down to a frequency range in which processing devices are more available and less costly.

Translation of operating frequency transfers the inter-element phase difference of intermediate frequencies to a higher antenna frequency without change so that the antenna scans much as it would at the intermediate frequencies. The only difference is a scale factor α/β. The following equations have been derived to express this frequency transfer:

$$\text{output frequency: } f_A = f_{IF} + f_{LO} \tag{5}$$

$$\text{inter—element phase: } \Delta\phi_A = \Delta\phi_{IF} = 2\pi\Delta L f_s / v \tag{6}$$

$$\text{scan angle: } \sin\theta_A = (\alpha/\beta)\sin\theta_{IF} = \frac{c}{D_A f_A}\left(\frac{\Delta L f_s}{v} - m\right) \tag{7}$$

$$\text{beam squint: } \frac{d\theta_A}{df_A} = \frac{-c}{D_A f_A^2 \cos\theta_A}\left(\frac{\Delta L f_s}{v} - m\right) \tag{8}$$

These equations assume an effective intermediate-frequency inter-element spacing $D_{IF}=\alpha\lambda_{IF}$ and an actual antenna element spacing $D_A=\beta\lambda_A$. As can be seen from the scan angle equation, if α=β, then the scan angle of the actual antenna will be equal to that at the intermediate frequency.

Various criteria are considered in the selection of the magnitude of the delta fiber length ΔL. Because this length sets the phase slope of the progressive-length manifold (manifold 32 in FIG. 1), it also sets the frequency range of the scanning signals that is required to scan an antenna beam across its designed scan angle. If the delta fiber length ΔL is set at a small value, it may require a scanning range that is too large to be easily realized. Conversely, if the delta fiber length ΔL is set at a large value, the scanning range may be undesirably small.

The spacing between the operating regions of FIG. 10 (e.g., as also shown in FIG. 12), can be controlled by selection of the delta fiber length ΔL. Decreasing this length causes the regions to move farther apart and increasing it causes them to move closer together. Thus the delta fiber length ΔL can be used as another tool in the selection of operating points for multibeam radiation and reception.

As indicated by FIGS. 1 and 2D, information is carried on the reference signals that propagate through the equal-length manifolds of the invention. Accordingly, that information arrives simultaneously at each radiative module 28 of the antenna. Because it is radiated from all array elements, it generates the narrow beam that the antenna was designed to radiate. Conversely, if the information were carried on the scanning signal it would arrive at different radiative elements at different times. The array would then erroneously emit broad beams that correspond to radiation from single array elements. The arrangements of antennas of the invention therefore reduce undesirable beam broadening, i.e., reduce beam squinting.

An exemplary two beam, two dimensional antenna with intermediate-frequency photonic manifolds scans ±70° and operates in the 7.25–7.75 GHz receive region and the 7.9–8.4 GHz transmit region. The operating signal $s_o$ at the manifolds is in the range of 800–1300 MHz, beam squint is 0.02 degrees/MHz at maximum scan angle and spurious responses are <−40 dB below the main beam.

The embodiments of the invention described herein are exemplary and numerous modifications, variations and rearrangements can be made without departing from the spirit and scope of the invention as defined in the appended claims.

We claim:

1. A multibeam phased array antenna, comprising:

a first photonic manifold that has an electrical input and n electrical outputs that are each spaced from said input by a respective one of optical paths whose lengths progressively increase by a selected path length ΔL;

a second photonic manifold that has an electrical input and a plurality of electrical outputs that are each spaced from said input by a respective one of equal-length optical paths;

an electronic signal generator which supplies a plurality of signal pairs wherein each of said signal pairs includes a respective frequency-swept scanning signal $s_s$ and a respective reference signal $s_r$ whose frequency is substantially a selected one of the sum and the difference of the frequencies of the scanning signal $s_s$ and a respective operating signal $s_o$;

a first signal combiner which combines the scanning signals $s_s$ of said signal pairs and delivers them to the electrical input of said first photonic manifold;

a second signal combiner which combines the reference signals $s_r$ of said signal pairs and delivers them to the electrical input of said second photonic manifold; and an array of radiative modules that each include:

a) an electromagnetic radiator;

b) a mixer that is coupled to said radiator, is coupled to a respective one of the electrical outputs of said first photonic manifold to receive the scanning signals $s_s$ of said signal pairs and is coupled to a respective one of the electrical outputs of said second photonic manifold to receive the reference signals $s_r$ of said signal pairs; and c) a filter inserted between said mixer and said radiator and configured to pass the respective operating signal $s_o$ of each of said signal pairs.

2. The multibeam phased array antenna of claim 1, wherein said first and second photonic manifolds each include:

an optical signal generator having a modulation input port that receives a selected one of a scanning signal $s_s$ and a reference signal $s_r$ of said electronic signal generator;

a plurality of optical fibers which each form a respective one of said optical paths;

an optical splitter that couples said optical generator to an end of each of said optical fibers; and a plurality of optical detectors coupled to another end of each of said optical fibers.

3. The multibeam phased array antenna of claim 2, wherein said optical signal generator is a diode laser.

4. The multibeam phased array antenna of claim 2, wherein said optical signal generator includes:

an optical light source; and an electro-optic modulator coupled to said optical light source.

5. The multibeam phased array antenna of claim 4, wherein said optical light source is a laser.

6. The multibeam phased array antenna of claim 2, wherein said optical detectors are each a photodiode.

7. The multibeam phased array antenna of claim 1, wherein each signal pair of said electronic signal generator is formed with:

a scanning-signal generator which supplies the scanning signal $s_s$ of said signal pair;

an operating-signal generator which supplies the operating signal $s_o$ of said signal pair;

a mixer coupled to said scanning-signal generator and said operating-signal generator; and a filter coupled to said mixer and configured to pass said reference signal $s_r$.

8. The multibeam phased array antenna of claim 1, wherein said radiator is a slot antenna.

9. The multibeam phased array antenna of claim 1, wherein said radiator is a horn antenna.

10. A multibeam phased array antenna, comprising:

a first photonic manifold that has an electrical input and n electrical outputs that are each spaced from said input by a respective one of optical paths whose lengths progressively increase by a selected path length $\Delta L$;

a second photonic manifold that has an electrical input and a plurality of electrical outputs that are each spaced from said input by a respective one of equal-length optical paths;

an electronic signal generator which supplies a plurality of signal pairs wherein each of said signal pairs includes a respective frequency-swept scanning signal $s_s$ and a respective reference signal $s_r$ whose frequency is substantially a selected one of the sum and the difference of the frequencies of the scanning signal $s_s$ and an operating signal $s_o$;

a first signal combiner which combines the scanning signals $s_s$ of said signal pairs and delivers them to the electrical input of said first photonic manifold;

a second signal combiner which combines the reference signals $s_r$ of said signal pairs and delivers them to the electrical input of said second photonic manifold;

an array of radiative modules that each include:

a) an electromagnetic radiator;

b) a mixer that is coupled to said radiator, is coupled to a respective one of the electrical outputs of said first photonic manifold to receive the scanning signals $s_s$ of said signal pairs and is coupled to a respective one of the electrical outputs of said second photonic manifold to receive the reference signals $s_r$ of said signal pairs;

c) a filter inserted between said mixer and said radiator and configured to pass the respective operating signal $s_o$ of each of said signal pairs; and d) a signal upconverter inserted between said filter and said radiator;

a third photonic manifold that has an electrical input and a plurality of electrical outputs that are each spaced from said input by a respective one of equal-length optical paths wherein each of said outputs is coupled to a respective one of said upconverters; and a local oscillator that is coupled to the input of said third photonic manifold.

11. The multibeam phased array antenna of claim 10, wherein said first and second photonic manifolds each include:

an optical signal generator having a modulation input port that receives a selected one of a scanning signal $s_s$ and a reference signal $s_r$ of said electronic signal generator;

a plurality of optical fibers which each form a respective one of said optical paths;

an optical splitter that couples said optical generator to an end of each of said optical fibers; and a plurality of optical detectors coupled to another end of each of said optical fibers.

12. The multibeam phased array antenna of claim 11, wherein said optical signal generator is a diode laser.

13. The multibeam phased array antenna of claim 11, wherein said optical signal generator includes:

an optical light source; and an electro-optic modulator coupled to said optical light source.

14. The multibeam phased array antenna of claim 13, wherein said optical light source is a laser.

15. The multibeam phased array antenna of claim 11, wherein said optical detectors are each a photodiode.

16. The multibeam phased array antenna of claim 11, wherein each signal pair of said electronic signal generator is formed with:

a scanning-signal generator which supplies the scanning signal $s_s$ of said signal pair;

an operating-signal generator which supplies the operating signal $s_o$ of said signal pair;

a mixer coupled to said scanning-signal generator and said operating-signal generator; and a filter coupled to said mixer and configured to pass said reference signal $s_r$.

17. The multibeam phased array antenna of claim 11, wherein said radiator is a slot antenna.

18. The multibeam phased array antenna of claim 10, wherein each of said radiative modules further includes a signal downconverter coupled between said upconverter and said radiator;

and further including:

a fourth photonic manifold that has a plurality of electrical inputs and a plurality of electrical outputs that are each spaced from a respective input by a respective one of equal-length optical paths wherein each of said inputs is coupled to the downconverter of a respective one of said radiative modules; and a beam summer that is coupled to the output ports of said fourth photonic manifold.

19. A method of simultaneously scanning multiple radiated beams that each differ from a common boresight by a scan angle, comprising the steps of:

forming a plurality of signal pairs which each include a frequency-swept scanning signal $s_s$ and a reference signal $s_r$ whose frequency is a selected one of the sum and the difference of the frequencies of said scanning signal $s_s$ and a respective operating signal $s_o$;

passing the scanning signals of said signal pairs through n first paths whose lengths progressively increase by a selected path length $\Delta L$;

passing the reference signals of said signal pairs through n equal-length second paths;

selecting frequencies for the scanning signals of said signal pairs so that each scanning signal has a different integer number of $2\pi$ phase shifts over said path length $\Delta L$ when said scan angle is zero;

mixing the scanning signals from each of said first paths with the reference signals from a respective one of said second paths to form n sets of mixed signals;

filtering each of said sets of mixed signals to recover n phase-shifted versions of the respective operating signal $s_o$ of each of said signal pairs; and radiating each of said phase-shifted versions from a respective one of n array radiators to form n radiated beams.

20. The method of claim 19, wherein said selecting step includes the step of choosing the integer numbers that correspond to said scanning signals so that scanning signals and reference signals of different signal pairs form mixing products that can be rejected by said filtering step.

* * * * *